US007297017B2

(12) United States Patent
Chien

(10) Patent No.: US 7,297,017 B2
(45) Date of Patent: Nov. 20, 2007

(54) METHOD FOR SAFELY REMOVING CONNECTING DEVICE OF PERIPHERAL EQUIPMENT OF COMPUTER

(75) Inventor: Min-Ru Chien, Sindian (TW)

(73) Assignee: Giga-Byte Technology Co., Ltd., Taipei County (TW)

( * ) Notice: Subject to any disclaimer, the term of this patent is extended or adjusted under 35 U.S.C. 154(b) by 154 days.

(21) Appl. No.: 11/012,136

(22) Filed: Dec. 16, 2004

(65) Prior Publication Data

US 2006/0134968 A1 Jun. 22, 2006

(51) Int. Cl.
*H01R 13/00* (2006.01)

(52) U.S. Cl. ..... 439/476.1

(58) Field of Classification Search ..... 439/476.1, 439/477, 92, 607–610, 66–67
See application file for complete search history.

(56) References Cited

U.S. PATENT DOCUMENTS 4,688,863 A * 8/1987 Oostlander ..... 439/92
5,201,855 A * 4/1993 Ikola ..... 439/608
5,293,303 A * 3/1994 Fletcher et al. ..... 361/798
5,393,245 A * 2/1995 Hinds, Jr. ..... 439/477
5,882,227 A * 3/1999 Neidich ..... 439/608
6,261,122 B1 * 7/2001 Richter ..... 439/477

* cited by examiner

*Primary Examiner*—J. F. Duverne
(74) *Attorney, Agent, or Firm*—Rosenberg, Klein & Lee

(57) ABSTRACT

A method is used for safely removing a first device from a second device, e.g., removing a first connector from a matching second connector or removing an interface converter from a mother board of a computer. Thus, the loop of the soft strap mounted on the first device allows passage of a user's one finger, so that the user's one finger directly exerts a straight outward force on the loop of the soft strap to easily remove the first device from the second device in a straight manner without producing deflection, thereby removing the first device from the second device easily and safely without damaging the first device or the second device during the pulling process.

12 Claims, 8 Drawing Sheets

METHOD FOR SAFELY REMOVING CONNECTING DEVICE OF PERIPHERAL EQUIPMENT OF COMPUTER

BACKGROUND OF THE INVENTION

1. Field of the Invention

The present invention relates to a method for safely removing a connecting device of a peripheral equipment of a computer, and more particularly to a method for easily and safely removing a first device from a second device, e.g., removing a first connector from a matching second connector or removing an interface converter from a mother board of a computer.

2. Description of the Related Art

A conventional connector 8 in accordance with the prior art shown in FIG. 10 has a first side attached to a serial bus 80 and a second side detachably inserted into a slot 90 of a mother board 9 of a computer. However, the connector 8 only has a smaller portion protruding from the slot 90 of the mother board 9, so that a user has to exert a larger pulling force to pull the connector 8 outward from the slot 90 of the mother board 9. Thus, the connector 8 cannot be directly removed from the slot 90 of the mother board 9 easily and safely, so that the connector 8 and the slot 90 of the mother board 9 are easily damaged during the pulling process due to the larger pulling force.

SUMMARY OF THE INVENTION

The primary objective of the present invention is to provide a method for easily and safely removing a first device from a second device.

Another objective of the present invention is to provide a method that is used for removing a first device from a second device in a easier and safer manner, without damaging the first device or the second device during the pulling process.

A further objective of the present invention is to provide a safely pulling method, wherein the loop of the soft strap mounted on the first device allows passage of a user's one finger, so that the user's one finger directly exerts a straight outward force on the loop of the soft strap to easily remove the first device from the second device in a straight manner without producing deflection, thereby removing the first device from the second device easily and safely without damaging the first device or the second device during the pulling process.

A further objective of the present invention is to provide a safely pulling method, wherein the soft strap is foldable easily without occupying space.

In accordance with one embodiment of the present invention, there is provided a method for safely removing a first device from a second device, comprising:

providing a soft strap;

combining a first portion of the soft strap with the first device; and suspending a second portion of the soft strap outward from the first device to form a loop.

In accordance with another embodiment of the present invention, there is provided a connector, comprising:

a main body;

a soft strap extended through the main body and formed with at least one loop protruding outward from the main body to allow passage of a user's one finger.

In accordance with another embodiment of the present invention, there is provided an interface converter, comprising:

a housing; and a soft strap having a first portion combined with the housing and a second portion suspended outward from the housing and formed with at least one loop to allow passage of a user's one finger.

Further benefits and advantages of the present invention will become apparent after a careful reading of the detailed description with appropriate reference to the accompanying drawings.

DETAILED DESCRIPTION OF THE INVENTION

Figure 2:
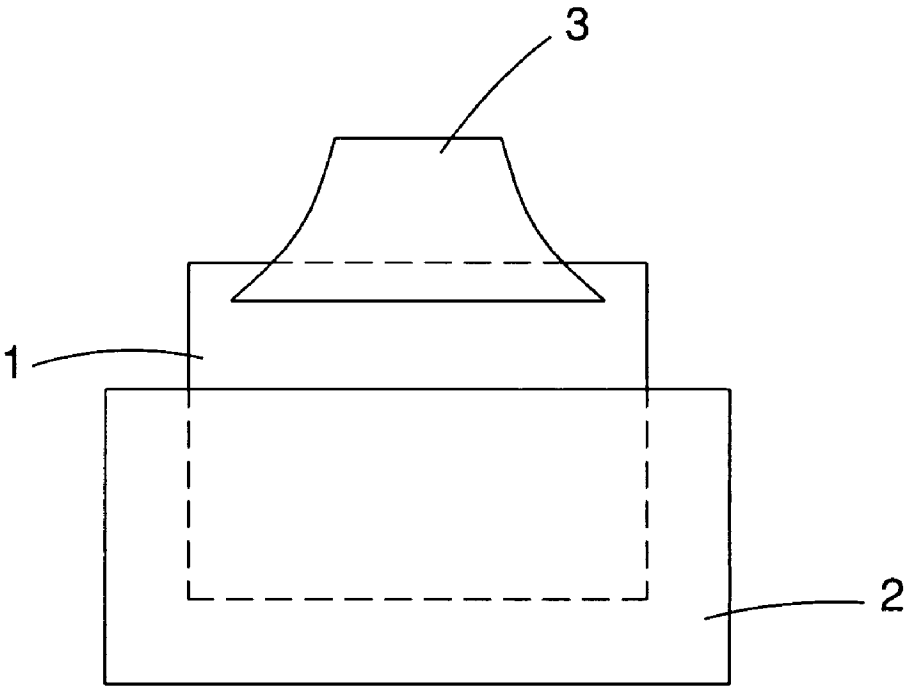
FIG. 2 is a bottom plan view of the connector as shown in FIG. 1.
Figure 1:
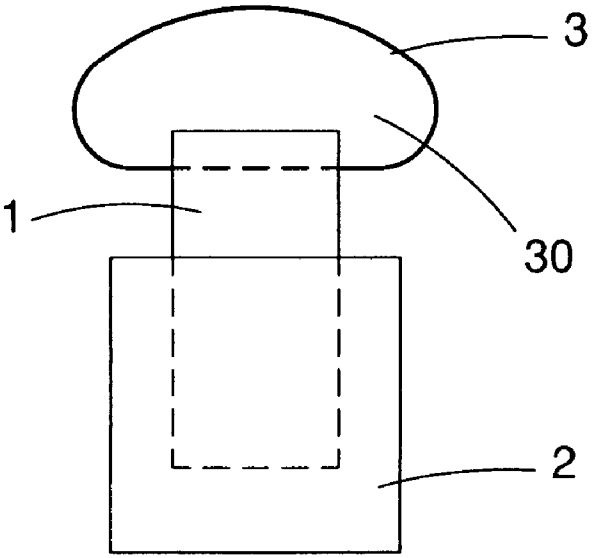
FIG. 1 is a side plan view of a connector in accordance with the preferred embodiment of the present invention.

Referring to the drawings and initially to FIGS. 1 and 2, a method in accordance with the preferred embodiment of the present invention is used for safely removing a first device 1 from a second device 2 and comprises the following steps:

providing a soft strap 3;

combining a first portion of the soft strap 3 with the first device 1; and suspending a second portion of the soft strap 3 outward from the first device 1 to form a loop 30.

Preferably, the soft strap 3 is a flexible strap made of plastic material, such as PVC or the like.

As shown in FIGS. 1 and 2, the soft strap 3 is attached to the first device 1 and is formed with a loop 30 protruding outward from the first device 1.

Figure 3:
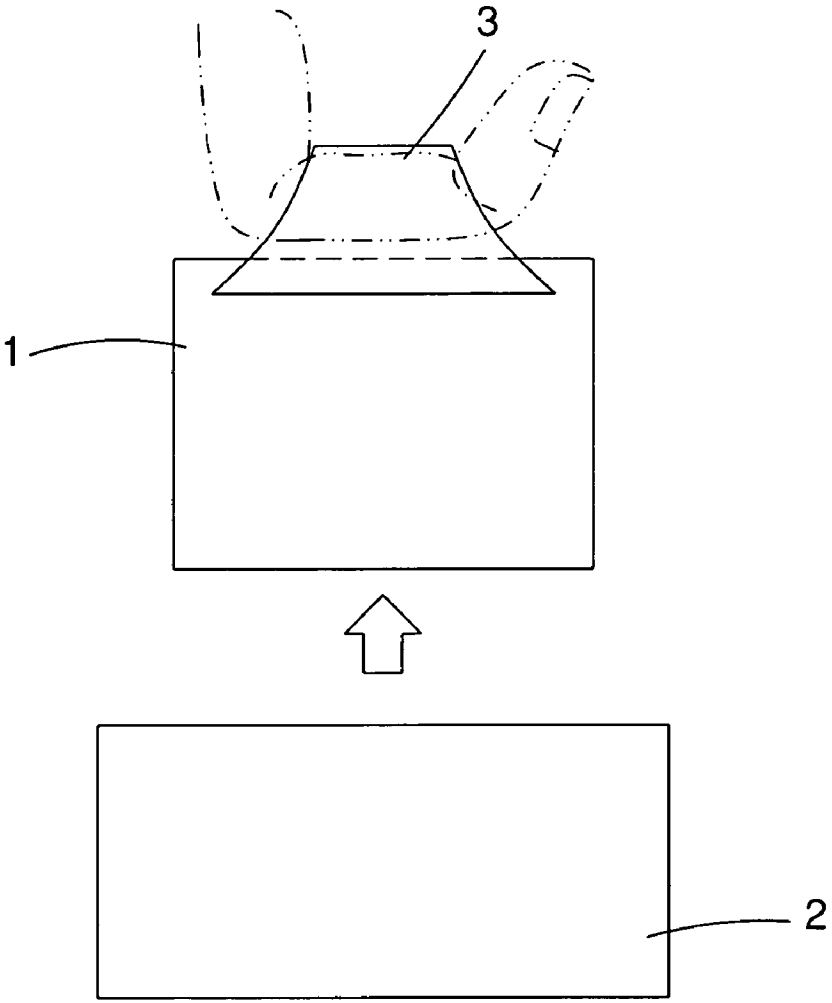
FIG. 3 is a schematic operational view of the connector as shown in FIG. 2.

As shown in FIG. 3, the loop 30 of the soft strap 3 allows passage of a user's one finger, so that the user's one finger directly exerts an upward force on the loop 30 of the soft strap 3 to easily remove the first device 1 from the second device 2 in a straight manner without producing deflection, thereby removing the first device 1 from the second device 2 safely without damaging the first device 1 or the second device 2 during the pulling process.

Figure 4:
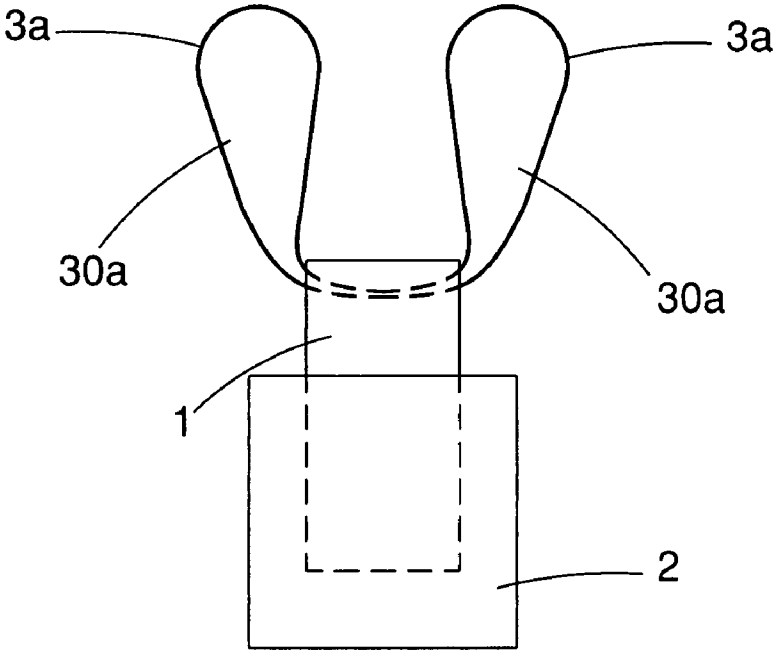
FIG. 4 is a side plan view of a connector in accordance with another embodiment of the present invention.

Referring to FIG. 4, in accordance with another embodiment of the present invention, the soft strap 3*a* has two loops 30*a* to allows passage of a user's two fingers.

Figure 5:
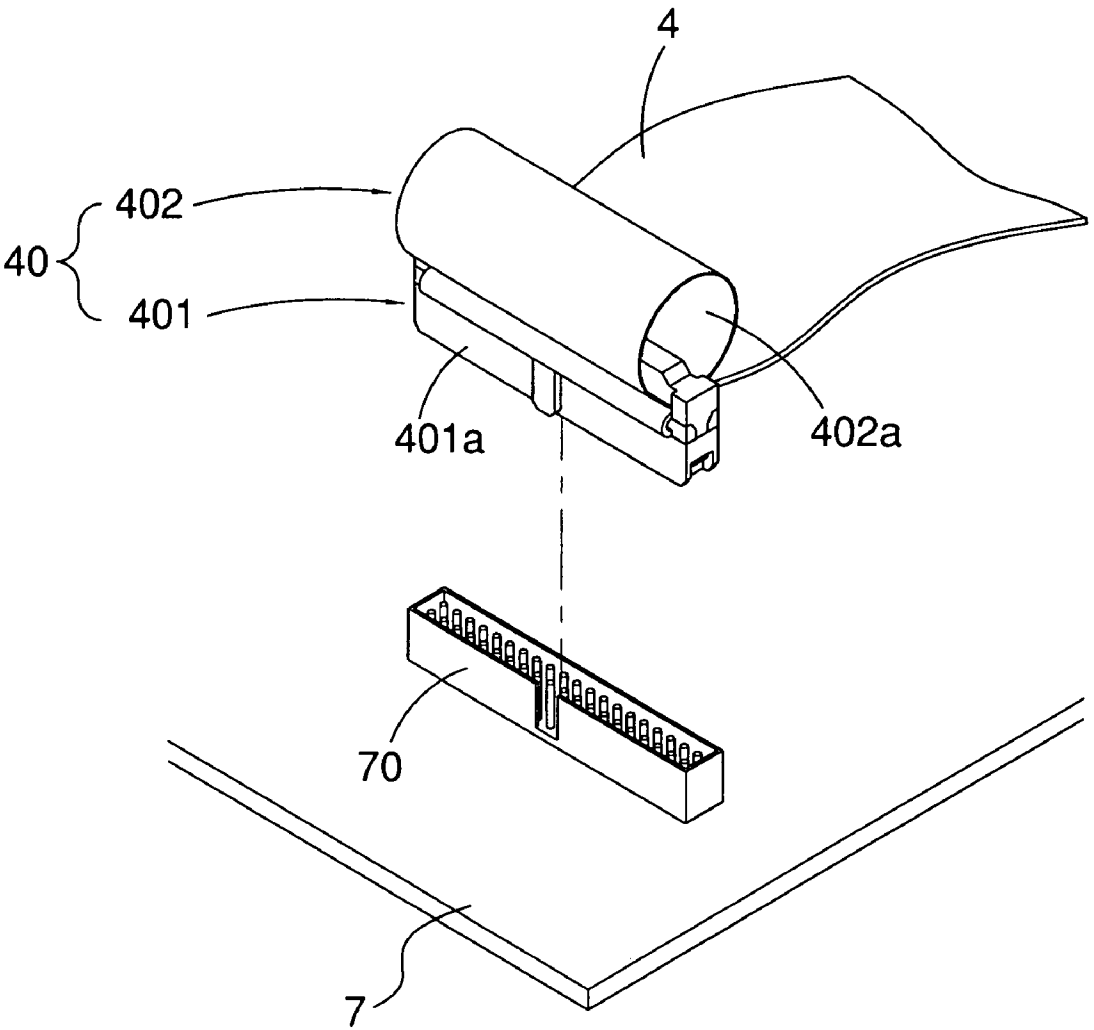
FIG. 5 is a perspective view of a connector in accordance with another embodiment of the present invention.

Referring to FIG. 5, in accordance with another embodiment of the present invention, the first device 1 is a first connector 40 mounted on a serial bus 4 of a computer, and the second device 2 is a second connector 70 mounted on a mother board 7 of the computer. The first connector 40 includes a main body 401 attached to the serial bus 4, a soft strap 402 extended through the main body 401 and formed with a loop 402*a* protruding outward from the main body 401 to allow passage of a user's one finger, and a plug 401*a* mounted on the main body 401 and detachably inserted into the second connector 70. Thus, the first connector 40 is safely removed from the second connector 70 by aid of the loop 402*a* of the soft strap 402.

Figure 6:
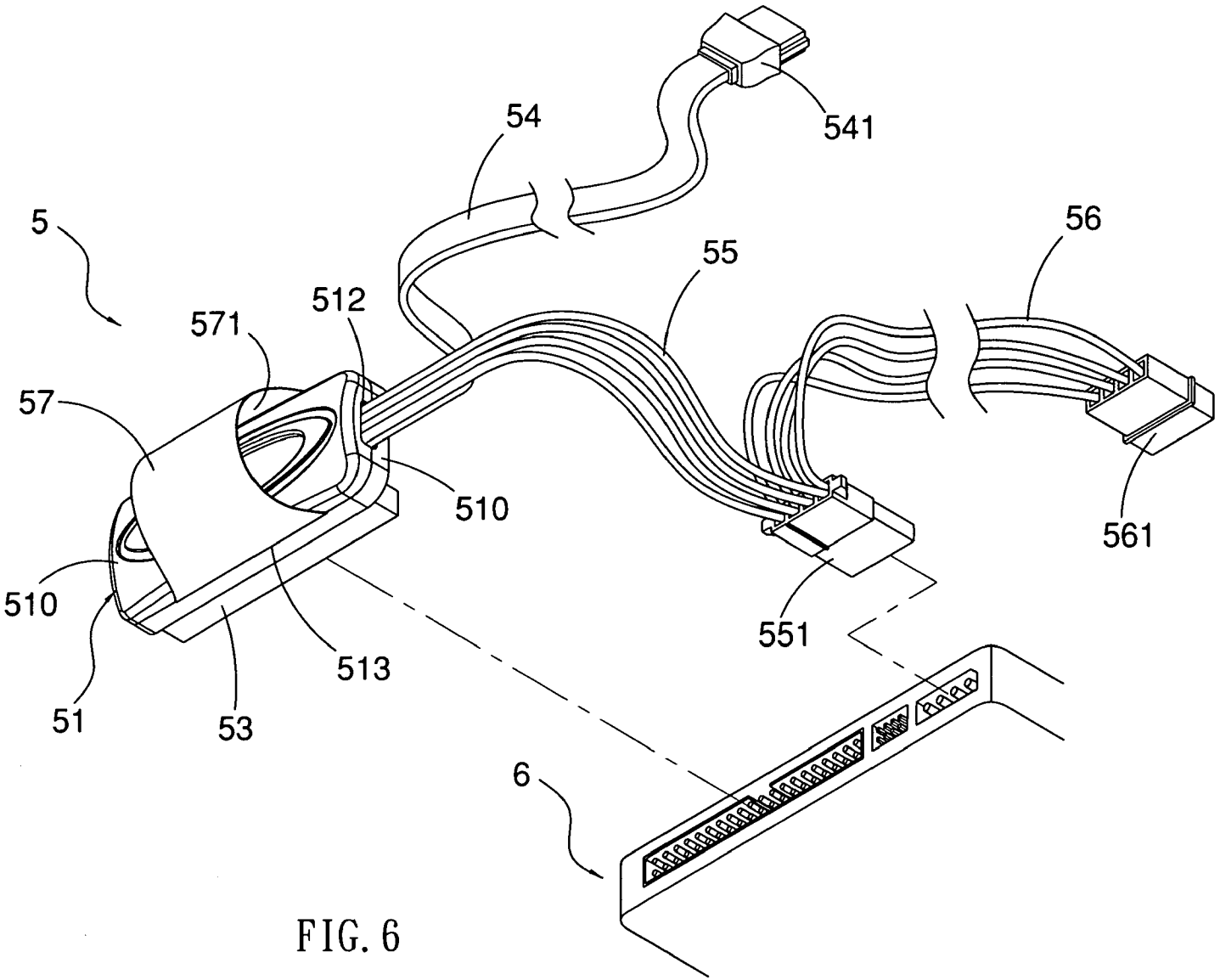
FIG. 6 is a perspective view of an interface converter in accordance with another embodiment of the present invention.
Figure 7:
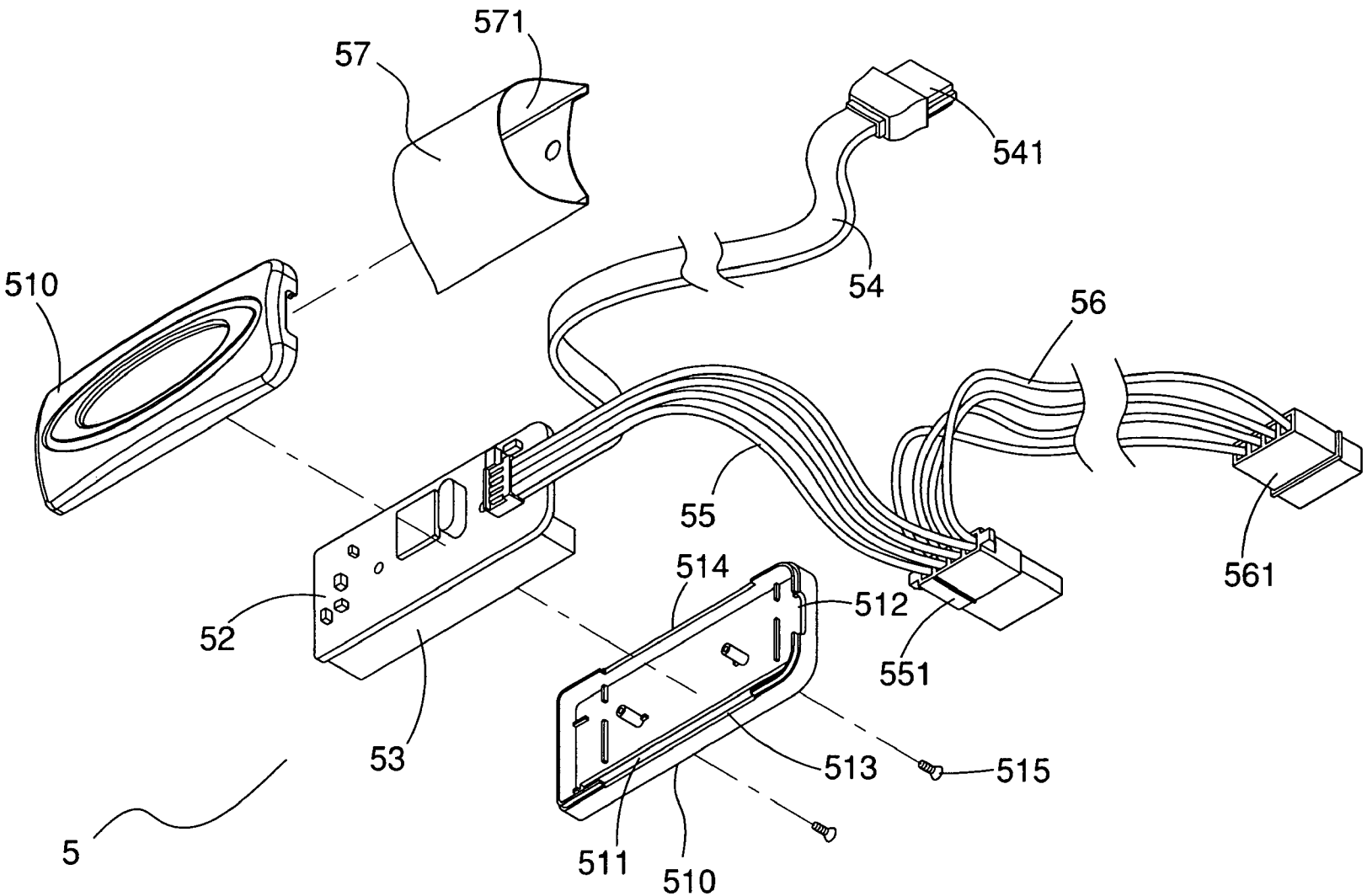
FIG. 7 is an exploded perspective view of the interface converter as shown in FIG. 6.
Figure 8:
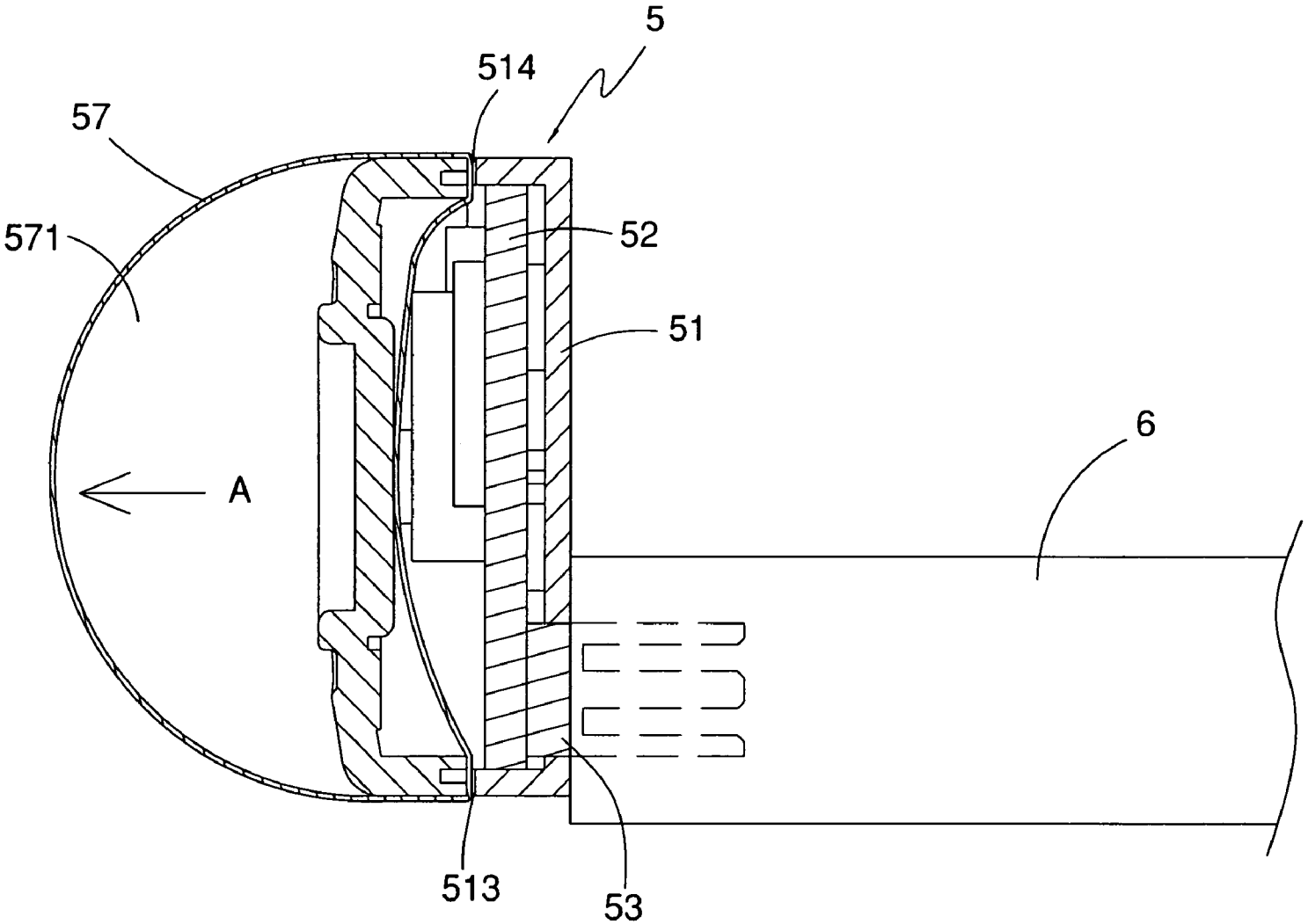
FIG. 8 is a plan cross-sectional view of the interface converter as shown in FIG. 6.

Referring to FIGS. 6-8, in accordance with another embodiment of the present invention, an interface converter 5 is used to perform an interface converting function between a first device and a second device. In the preferred embodiment of the present invention, the first device is an IDE device 6 (such as a hard disk drive or an optical disk drive), and the second device is a mother board (not shown) of a computer. In general, the IDE device 6 has a parallel ATA interface, and the mother board has a serial ATA interface. Thus, the interface converter 5 is used to convert the serial ATA interface of the mother board into the parallel ATA interface of the IDE device 6, so that the mother board is connected to the IDE device 6 for use with the IDE device 6.

The interface converter 5 includes a housing 51 having a back face formed with a first hole 511, a shorter side formed with a second hole 512, two opposite longer sides formed with a third hole 513 and a fourth hole 514, a circuit board 52 mounted in the housing 51, a first connector 53 mounted in the housing 51 and having a first side protruding outward from the first hole 511 of the housing 51 and a second side electrically connected to the circuit board 52, a connecting cable 54 having a first end extended through the second hole 512 of the housing 51 and electrically connected to the circuit board 52 and a second end electrically connected to a second connector 541, a first power cable 55 having a first end extended through the second hole 512 of the housing 51 and electrically connected to the circuit board 52 and a second end electrically connected to a third connector 551, a second power cable 56 having a first end electrically connected to the third connector 551 and a second end electrically connected to a fourth connector 561, and a soft strap 57 having a first portion combined with the housing 51 and a second portion suspended outward from the housing 51 and formed with at least one loop 571 to allow passage of a user's one finger.

The housing 51 includes two casings 510 combined with each other by screws 515. The circuit board 52 is used to convert the serial ATA interface of the mother board into the parallel ATA interface of the IDE device 6.

The first side of the first connector 53 of the interface converter 5 is protruded outward from the first hole 511 of the housing 51 and detachably inserted into the IDE device 6 to form an electrical connection. The second connector 541 is detachably inserted into the mother board of the computer to form an electrical connection. Thus, the IDE device 6 is connected to the mother board of the computer by the interface converter 5, so that the mother board of the computer is for use with the IDE device 6.

In addition, the interface converter 5 is connected to a power supply (not shown) by the fourth connector 561 to obtain an electrical power from the power supply, and the third connector 551 of the interface converter 5 is connected to the IDE device 6, so that the power supply also supplies the electrical power to the IDE device 6.

The first portion of the soft strap 57 is extended through the third hole 513 and the fourth hole 514 of the housing 51, so that the soft strap 57 is fixed to the housing 51 rigidly and stably without detachment.

As shown in FIG. 8, the loop 571 of the soft strap 57 allows passage of a user's one finger, so that the user's one finger directly exerts a straight outward force (in the direction indicated by the arrow "A") on the loop 571 of the soft strap 57 to easily remove the first connector 53 of the interface converter 5 from the IDE device 6 in a straight manner without producing deflection, thereby removing the first connector 53 of the interface converter 5 from the IDE device 6 safely without damaging the first connector 53 of the interface converter 5 or the IDE device 6 during the pulling process.

Figure 9:
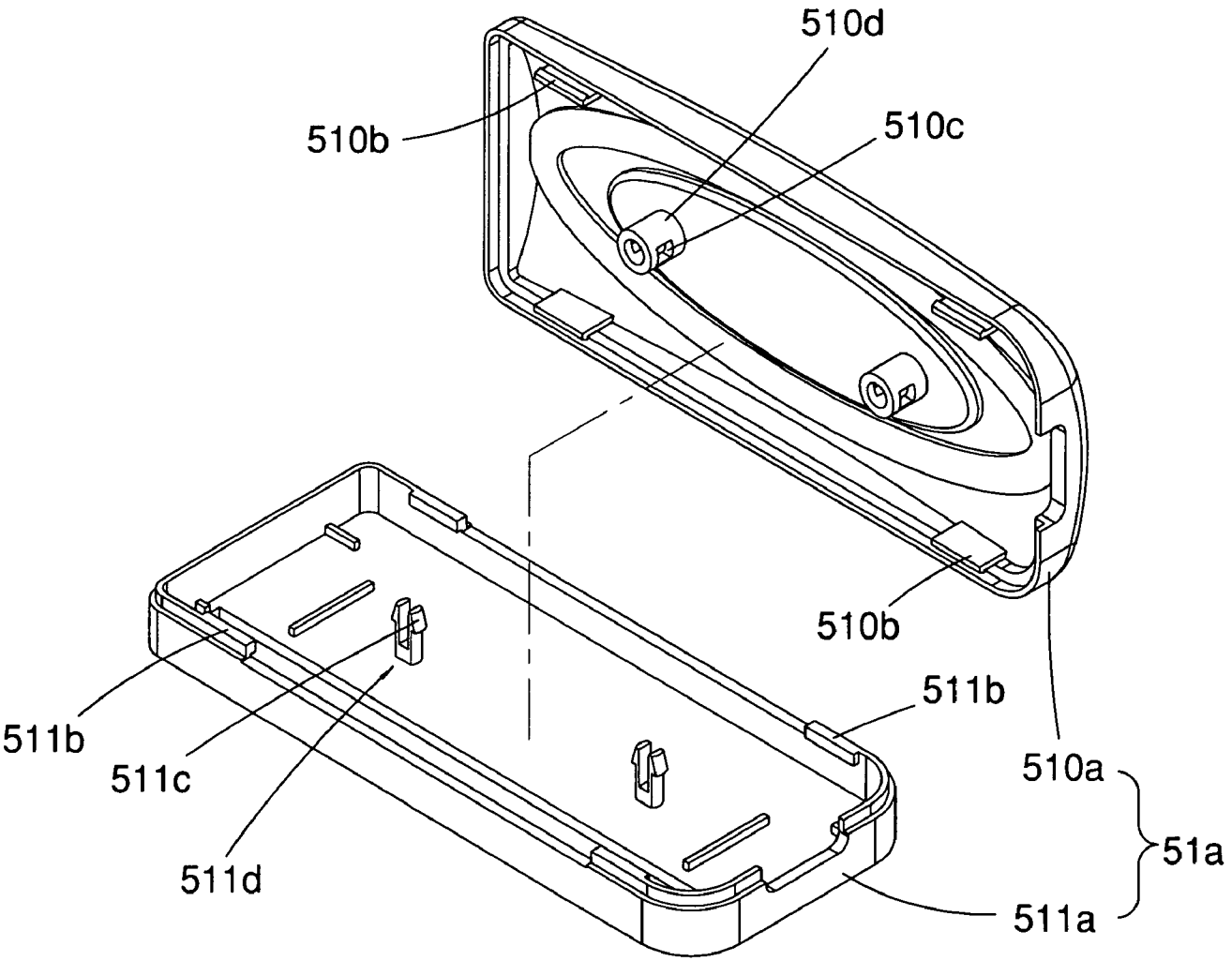
FIG. 9 is an exploded perspective view of a housing of an interface converter in accordance with another embodiment of the present invention.
Figure 10:
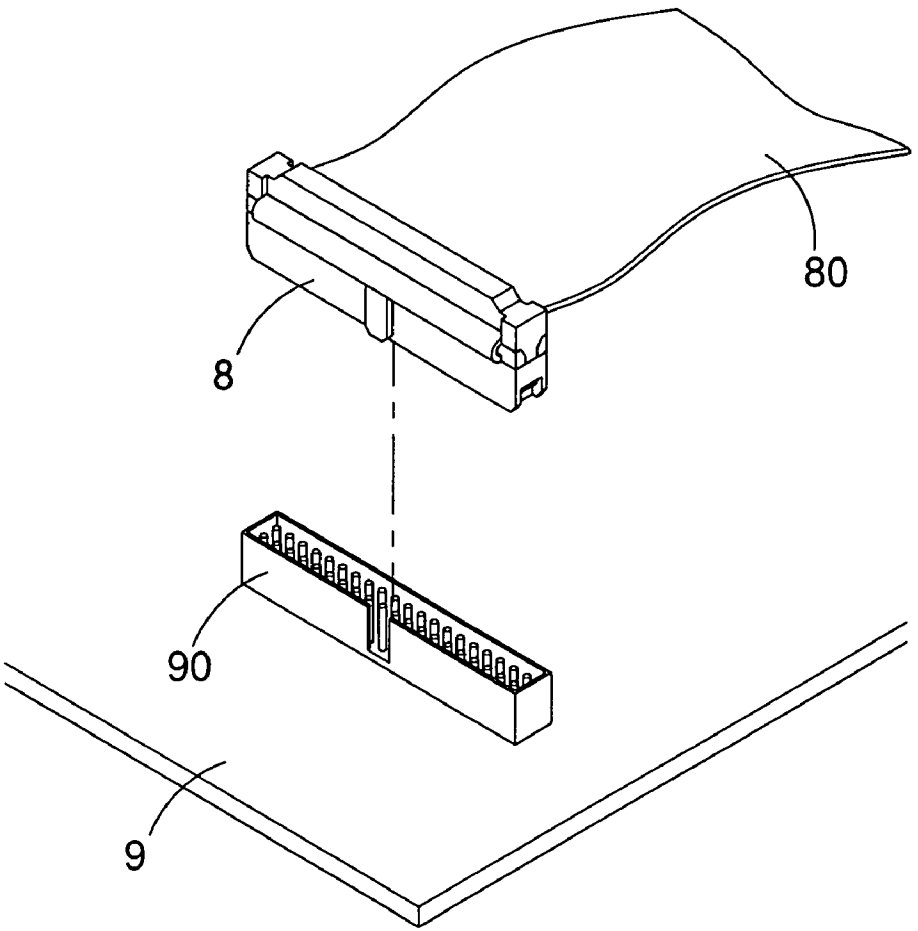
FIG. 10 PRIOR ART
FIG. 10 is an exploded perspective view of a conventional connector in accordance with the prior art.

Referring to FIG. 9, in accordance with another embodiment of the present invention, the housing 51*a* includes a first casing 510*a* and a second casing 511*a* combined with each other in a snapping manner.

The second casing 511*a* has a peripheral wall provided with a plurality of inverted L-shaped locking blocks 511*b*, and the first casing 510*a* has a peripheral wall provided with a plurality of L-shaped locking hooks 510*b* each snapped on a respective one of the locking blocks 511*b* of the second casing 511*a*, so that the first casing 510*a* and the second casing 511*a* are combined with each other.

In addition, the first casing 510*a* has a side provided with a plurality of fixing barrels 510*d* each having a peripheral wall formed with two radially opposite snapping holes 510*c*, and the second casing 511*a* has a side provided with a plurality of forked fixing posts 511*d* each secured in a respective one of the fixing barrels 510*d* of the first casing 510*a* and each formed with two opposite barbs 511*c* each snapped into and locked in a respective one of the snapping holes 510*c* of the respective fixing barrel 510*d* of the first casing 510*a*, so that the first casing 510*a* and the second casing 511*a* are combined with each other rigidly and stably.

Accordingly, the method of the present invention is used for removing a first device from a second device in a easier and safer manner, without damaging the first device or the second device during the pulling process. In addition, the loop of the soft strap mounted on the first device allows passage of a user's one finger, so that the user's one finger directly exerts a straight outward force on the loop of the soft strap to easily remove the first device from the second device in a straight manner without producing deflection, thereby removing the first device from the second device easily and safely without damaging the first device or the second device during the pulling process.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An interface converter, comprising:

a housing including a first hole;

a circuit board disposed in the housing;

a first connector disposed in the housing and including a first side protruding from the first hole of the housing and a second side electrically connected to the circuit board; and a soft strap having a first portion combined with the housing and a second portion suspended outward from the housing and formed with at least one loop for receiving a user's one finger so that the user can pull the strap to displace the body.

2. The interface converter in accordance with claim 1, wherein the first side of the first connector is detachably inserted into a first device to form an electrical connection.

3. The interface converter in accordance with claim 2, wherein the housing has a second hole, and the interface converter further comprises a connecting cable having a first end extended through the second hole of the housing and electrically connected to the circuit board and a second end electrically connected to a second connector, a first power cable having a first end extended through the second hole of the housing and electrically connected to the circuit board and a second end electrically connected to a third connector, a second power cable having a first end electrically connected to the third connector and a second end electrically connected to a fourth connector.

4. The interface converter in accordance with claim 3, wherein the second connector is detachably inserted into a second device to form an electrical connection.

5. The interface converter in accordance with claim 1, wherein the circuit board is used to convert a serial ATA interface of a device into a parallel ATA interface of another device.

6. The interface converter in accordance with claim 3, wherein the third connector of the interface converter is connected to the first device.

7. The interface converter in accordance with claim 3, wherein the fourth connector is connected to a power supply.

8. The interface converter in accordance with claim 1, wherein the housing has two opposite through holes, and the first portion of the soft strap is extended through the two opposite through holes of the housing, so that the soft strap is fixed to the housing.

9. The interface converter in accordance with claim 1, wherein the housing includes two casings combined with each other by screws.

10. The interface converter in accordance with claim 1, wherein the housing includes a first casing and a second casing combined with each other in a snapping manner.

11. The interface converter in accordance with claim 10, wherein the second casing has a peripheral wall provided with a plurality of inverted L-shaped locking blocks, and the first casing has a peripheral wall provided with a plurality of L-shaped locking hooks each snapped on a respective one of the locking blocks of the second casing, so that the first casing and the second casing are combined with each other.

12. The interface converter in accordance with claim 10, wherein the first casing has a side provided with a plurality of fixing barrels each having a peripheral wall formed with two radially opposite snapping holes, and the second casing has a side provided with a plurality of forked fixing posts each secured in a respective one of the fixing barrels of the first casing and each formed with two opposite barbs each snapped into and locked in a respective one of the snapping holes of the respective fixing barrel of the first casing, so that the first casing and the second casing are combined with each other.

* * * * *